US008624735B2

(12) United States Patent
Kellen et al.

(10) Patent No.: US 8,624,735 B2
(45) **Date of Patent: *Jan. 7, 2014**

(54) ALARM SYSTEM HAVING AN INDICATOR LIGHT THAT IS EXTERNAL TO AN ENCLOSED SPACE FOR INDICATING THE SPECIFIC LOCATION OF AN INTRUSION INTO THE ENCLOSED SPACE AND A METHOD FOR INSTALLING THE ALARM SYSTEM

(76) Inventors: Yael Debra Kellen, Teaneck, NJ (US); Arl Saul Kellen, Teaneck, NJ (US)

( * ) Notice: Subject to any disclaimer, the term of this patent is extended or adjusted under 35 U.S.C. 154(b) by 387 days.

This patent is subject to a terminal disclaimer.

(21) Appl. No.: 12/949,738

(22) Filed: Nov. 18, 2010

(65) Prior Publication Data

US 2012/0126978 A1 May 24, 2012

(51) Int. Cl.
*G08B 13/00* (2006.01)

(52) U.S. Cl.
USPC ..... 340/541; 340/545.1; 340/565

(58) Field of Classification Search
USPC ..... 340/541, 524, 545.1, 545.2, 545.3, 340/545.7, 545.9, 565, 506
See application file for complete search history.

(56) References Cited

U.S. PATENT DOCUMENTS

| | | | |
|---|---|---|---|
| 3,601,540 | A | 8/1971 | McNeil |
| 3,745,550 | A | 7/1973 | Anthony et al. |
| 3,774,190 | A | 11/1973 | Kyle, Jr. |
| 3,789,384 | A | 1/1974 | Akers |
| 3,886,352 | A | 5/1975 | Lai |
| 3,911,425 | A | 10/1975 | Muncheryan |
| 4,021,679 | A | 5/1977 | Bolle et al. |
| 4,101,876 | A | 7/1978 | Lurkis et al. |
| 4,225,808 | A | 9/1980 | Saraceni |
| 4,242,670 | A | 12/1980 | Smith |
| 4,284,849 | A | 8/1981 | Anderson et al. |
| 4,305,021 | A | 12/1981 | Schreiden |
| 4,342,987 | A | 8/1982 | Rossin |

(Continued)

FOREIGN PATENT DOCUMENTS

| | | |
|---|---|---|
| CA | 2556137 | 8/2006 |
| EP | 0148708 A1 | 1/1984 |

(Continued)

OTHER PUBLICATIONS

US 4,992,701, 02/1991, Sacchetti (withdrawn).

(Continued)

*Primary Examiner* — Toan N Pham
(74) *Attorney, Agent, or Firm* — Russ Weinzimmer & Associates P.C.

(57) ABSTRACT

An alarm system for indicating the specific location of an intrusion into an enclosed space, as well as a method for installing the alarm system, are disclosed. The intrusion causes illumination of an indicator light outside the enclosed space and within the outer perimeter zone of the enclosed space, thereby indicating the specific location of the intrusion. At least one interior sensor located within the enclosed space generates a specific intrusion location signal in response to movement therein. A control system responsive to the specific intrusion location signal causes the indicator light to emit light that is visible from outside the outer perimeter zone of the enclosed space. The emitted light can indicate the specific location of an intrusion by directing light towards the specific intrusion location, and/or by surrounding the specific intrusion location, and/or by activating a light display that produces readable output of the specific intrusion location.

18 Claims, 11 Drawing Sheets

(56) References Cited

U.S. PATENT DOCUMENTS

| | | | | |
|---|---|---|---|---|
| 4,422,068 | A * | 12/1983 | Helft et al. | 340/514 |
| 4,484,075 | A | 11/1984 | Kahl, Jr. et al. | |
| 4,524,349 | A | 6/1985 | Hyatt | |
| 4,531,114 | A | 7/1985 | Topol et al. | |
| 4,547,761 | A | 10/1985 | Jones | |
| 4,589,081 | A | 5/1986 | Massa et al. | |
| 4,618,770 | A | 10/1986 | Maile | |
| 4,622,540 | A | 11/1986 | Guscott et al. | |
| 4,651,144 | A | 3/1987 | Pagano | |
| 4,727,593 | A | 2/1988 | Goldstein | |
| 4,730,184 | A | 3/1988 | Bach | |
| 4,754,263 | A | 6/1988 | Trimble | |
| 4,763,937 | A | 8/1988 | Sittnick, Jr. et al. | |
| 4,804,275 | A | 2/1989 | Kang et al. | |
| 4,843,283 | A | 6/1989 | Chen | |
| 4,862,141 | A | 8/1989 | Jordal | |
| 4,873,469 | A | 10/1989 | Young et al. | |
| 4,890,093 | A | 12/1989 | Allison et al. | |
| 4,902,887 | A | 2/1990 | Everett, Jr. | |
| 4,982,176 | A | 1/1991 | Schwarz | |
| 5,015,994 | A | 5/1991 | Hoberman et al. | |
| 5,126,718 | A | 6/1992 | Doctor | |
| 5,128,654 | A | 7/1992 | Griffin et al. | |
| 5,155,474 | A | 10/1992 | Park et al. | |
| 5,220,250 | A | 6/1993 | Szuba | |
| 5,262,758 | A | 11/1993 | Nam et al. | |
| 5,311,166 | A * | 5/1994 | Frye | 340/541 |
| 5,371,489 | A | 12/1994 | Carroll et al. | |
| 5,463,595 | A | 10/1995 | Roadhall et al. | |
| 5,471,194 | A | 11/1995 | Guscott | |
| 5,477,205 | A | 12/1995 | Burns | |
| 5,483,224 | A * | 1/1996 | Rankin et al. | 340/539.17 |
| 5,488,565 | A | 1/1996 | Kennon et al. | |
| 5,555,454 | A | 9/1996 | Dees | |
| 5,570,079 | A | 10/1996 | Dockery | |
| 5,587,704 | A | 12/1996 | Foster | |
| 5,598,066 | A | 1/1997 | Wiesemann et al. | |
| 5,691,699 | A | 11/1997 | Vane et al. | |
| 5,726,629 | A | 3/1998 | Yu | |
| 5,747,937 | A | 5/1998 | Wiesemann et al. | |
| 5,760,712 | A | 6/1998 | Sauer | |
| 5,831,529 | A | 11/1998 | Pantus | |
| 5,854,588 | A | 12/1998 | Dockery | |
| 5,867,099 | A | 2/1999 | Keeter | |
| 5,890,797 | A | 4/1999 | Bish | |
| 5,933,078 | A | 8/1999 | O'Donnell | |
| 6,049,274 | A | 4/2000 | Stachurski | |
| D424,727 | S | 5/2000 | Greubel | |
| 6,067,927 | A | 5/2000 | Johnson et al. | |
| 6,118,375 | A | 9/2000 | Duncan | |
| 6,320,506 | B1 | 11/2001 | Ferraro | |
| 6,323,780 | B1 | 11/2001 | Morris | |
| 6,359,564 | B1 | 3/2002 | Thacker | |
| 6,384,724 | B1 | 5/2002 | Landais | |
| 6,384,728 | B1 | 5/2002 | Kanor et al. | |
| 6,392,541 | B1 | 5/2002 | Bucher et al. | |
| 6,691,467 | B2 | 2/2004 | Hincher, Sr. | |
| 6,710,736 | B2 | 3/2004 | Fullerton et al. | |
| 6,741,176 | B2 | 5/2004 | Ferraro | |
| 6,747,275 | B2 | 6/2004 | Raper et al. | |
| 6,749,319 | B1 | 6/2004 | Muse | |
| 6,765,214 | B1 | 7/2004 | Kosslow et al. | |
| 6,891,566 | B2 | 5/2005 | Marchese | |
| 6,894,609 | B2 | 5/2005 | Menard et al. | |
| 6,903,655 | B2 | 6/2005 | Stefanik | |
| 6,933,854 | B1 | 8/2005 | Burgess | |
| 6,943,687 | B2 | 9/2005 | Lee et al. | |
| 6,956,478 | B2 * | 10/2005 | Oyagi et al. | 340/541 |
| 6,956,493 | B1 | 10/2005 | Youngblood | |
| 6,979,812 | B2 | 12/2005 | Al-Ali | |
| 6,998,994 | B2 | 2/2006 | Barnes et al. | |
| 7,019,669 | B1 | 3/2006 | Carr | |
| 7,034,934 | B2 | 4/2006 | Manning | |
| 7,036,951 | B2 | 5/2006 | St-Hilaire | |
| 7,155,166 | B2 | 12/2006 | Swan | |
| 7,178,952 | B2 | 2/2007 | Bucher et al. | |
| 7,239,238 | B2 | 7/2007 | Tester et al. | |
| 7,268,689 | B2 | 9/2007 | Sulaver | |
| 7,284,880 | B1 | 10/2007 | Steele | |
| 7,329,970 | B2 | 2/2008 | Bruwer | |
| 7,333,398 | B2 | 2/2008 | Thompson et al. | |
| 7,362,663 | B2 | 4/2008 | Kagan | |
| 7,492,306 | B2 | 2/2009 | Humphrey et al. | |
| 7,498,949 | B2 | 3/2009 | Ito et al. | |
| 2002/0014971 | A1 | 2/2002 | Ferraro | |
| 2002/0190859 | A1 | 12/2002 | Bucher et al. | |
| 2003/0016129 | A1 | 1/2003 | Menard et al. | |
| 2003/0122683 | A1 | 7/2003 | Downer | |
| 2004/0036603 | A1 * | 2/2004 | Bingham | 340/541 |
| 2004/0047153 | A1 | 3/2004 | Lee | |
| 2004/0049962 | A1 | 3/2004 | Moshirnoroozi | |
| 2004/0080615 | A1 | 4/2004 | Klein et al. | |
| 2004/0080627 | A1 | 4/2004 | Kroll et al. | |
| 2004/0150522 | A1 | 8/2004 | Krause | |
| 2004/0178921 | A1 | 9/2004 | Lawrence | |
| 2004/0201565 | A1 | 10/2004 | Cunningham et al. | |
| 2006/0083305 | A1 | 4/2006 | Dougherty et al. | |
| 2006/0197661 | A1 | 9/2006 | Tracy et al. | |
| 2006/0230434 | A1 | 10/2006 | Sunagawa | |
| 2007/0054618 | A1 | 3/2007 | Lewis et al. | |
| 2007/0064541 | A1 | 3/2007 | Kagan | |
| 2007/0075854 | A1 | 4/2007 | Tyler | |
| 2007/0109763 | A1 | 5/2007 | Wolf et al. | |
| 2007/0133356 | A1 | 6/2007 | O'Connor | |
| 2007/0195703 | A1 | 8/2007 | Boyajian et al. | |
| 2007/0222577 | A1 | 9/2007 | Wilson et al. | |
| 2007/0236360 | A1 | 10/2007 | Fitzgibbon | |
| 2007/0263968 | A1 | 11/2007 | Lath | |
| 2007/0268687 | A1 | 11/2007 | Scannell, Jr. | |
| 2007/0300091 | A1 | 12/2007 | Lee | |
| 2008/0151056 | A1 | 6/2008 | Ahamefula | |
| 2008/0232199 | A1 | 9/2008 | Shafton | |
| 2008/0252730 | A1 * | 10/2008 | Hong | 348/155 |
| 2008/0291036 | A1 | 11/2008 | Richmond | |
| 2009/0009326 | A1 | 1/2009 | Veiga, III | |
| 2009/0033460 | A1 | 2/2009 | Mack et al. | |
| 2009/0070076 | A1 | 3/2009 | Braunstein et al. | |
| 2009/0140858 | A1 | 6/2009 | Gore et al. | |

FOREIGN PATENT DOCUMENTS

| | | | |
|---|---|---|---|
| EP | 454313 | A3 | 4/1991 |
| EP | 687591 | A2 | 6/1995 |
| GB | 2244129 | A | 4/1991 |
| GB | 2380338 | A | 9/2001 |
| JP | 56103633 | A2 | 1/1980 |
| JP | 01299973 | A3 | 5/1988 |
| JP | 02095526 | A2 | 9/1988 |
| JP | 01286563 | A | 11/1989 |
| JP | 2000215356 | A2 | 1/1990 |
| JP | 04287756 | A2 | 3/1991 |
| JP | 04315687 | A2 | 4/1991 |
| JP | 06162364 | A2 | 11/1992 |
| JP | 06342082 | A2 | 5/1993 |
| JP | 06287537 | A2 | 7/1993 |
| JP | 07093686 | A2 | 9/1993 |
| JP | 08015428 | A2 | 6/1994 |
| JP | 08042209 | A2 | 7/1994 |
| JP | 10176312 | A2 | 12/1996 |
| JP | 10222788 | A2 | 2/1997 |
| JP | 10253757 | A2 | 3/1997 |
| JP | 11066472 | A2 | 8/1997 |
| JP | 11086159 | A2 | 9/1997 |
| JP | 11086168 | A2 | 9/1997 |
| JP | 11242784 | A2 | 2/1998 |
| JP | 11287875 | A2 | 3/1998 |
| JP | 11296767 | A2 | 4/1998 |
| JP | 2000085535 | A2 | 9/1998 |
| JP | 2000286978 | A | 3/1999 |
| JP | 2001032588 | A2 | 7/1999 |
| JP | 2001148845 | A2 | 11/1999 |
| JP | 2003198741 | A2 | 12/2001 |
| JP | 2002083383 | A | 3/2002 |
| JP | 2004192466 | A2 | 12/2002 |

(56) References Cited

FOREIGN PATENT DOCUMENTS

| | | | |
|---|---|---|---|
| JP | 2004206290 | A2 | 12/2002 |
| JP | 2004220101 | A2 | 1/2003 |
| JP | 2005011223 | A3 | 6/2003 |
| JP | 2005165993 | A2 | 11/2003 |
| JP | 2006011895 | A2 | 6/2004 |
| JP | 2005126996 | A | 5/2005 |
| JP | 2007054501 | A2 | 8/2005 |
| JP | 2007071658 | A2 | 9/2005 |
| JP | 2008076220 | A | 9/2006 |
| JP | 2006286276 | A | 10/2006 |
| JP | 2008158854 | A2 | 12/2006 |
| JP | 2007172438 | A | 5/2007 |
| JP | 2008040863 | A | 2/2008 |
| KR | 0385019 | B1 | 1/1999 |
| KR | 3047240 | A | 12/2001 |
| NZ | 0331250 | A | 8/1999 |
| RU | 2309861 | C1 | 11/2006 |
| WO | 9216916 | A1 | 3/1992 |
| WO | 9422118 | A1 | 9/1994 |
| WO | 0043968 | A1 | 1/2000 |
| WO | 0075900 | A1 | 6/2000 |
| WO | 0182004 | A1 | 4/2001 |
| WO | 0189369 | A3 | 5/2001 |
| WO | 0106473 | A3 | 11/2001 |
| WO | 2004044619 | A2 | 11/2003 |
| WO | 2004079684 | A1 | 9/2004 |
| WO | 2005022477 | A1 | 3/2005 |
| WO | 2006097920 | A3 | 9/2006 |
| WO | 2007016741 | A1 | 2/2007 |
| WO | 2007096583 | A1 | 2/2007 |
| WO | 2007034473 | A3 | 3/2007 |
| WO | 2007116452 | | 10/2007 |
| WO | 2007138308 | A2 | 12/2007 |
| WO | 2008054459 | A3 | 5/2008 |
| WO | 2008134927 | A1 | 11/2008 |

OTHER PUBLICATIONS http://www.residential-landscape-lighting-design.com/store/RLLD2739RAB.htm Downloaded on Mar. 15, 2009 Rab—Motion Sensor—Good Night—Light TUFF Dome.

http://www.x10.com/automation/index.html#motion_sensors Downloaded on Mar. 15, 2009.

http://www.x10.com/products/x10_ms16a.htm Downloaded on Mar. 15, 2009.

http://www.x10.com/activehomepro/plugins/plugin-myhouse.html Downloaded on Mar. 15, 2009.

http://www.crutchfield.com/S-bOzrkHXfCvd/p_514CG35015/Crime-Guard-350i5.html?tab=detailed_info Downloaded on Mar. 31, 2009.

http://elektron.uw.hu/elektro/PIC/riaszto/riaszto.pdf. Downloaded on Mar. 31, 2009.

http://archives.sensorsmag.com/articles/0902/32/main.shtml Downloaded on Mar. 31, 2009.

http://www.smarthome.com/73951/Wireless-Glassbreak-Sensor-MCT-501-315MHz-/p.aspx Downloaded Apr. 3, 2009.

http://www.arlec.com.au/instruct/DA200.pdf. Downloaded on Apr. 3, 2009.

http://www.maxximastyle.com/Merchant2/merchant.mvc?Screen=PROD&Product_Code=SDL-60&Category_Code=MN Downloaded on Apr. 3, 2009.

http://www.faqs.org/rulings/rulings1990HQ0085074.html Downloaded on Apr. 3, 2009.

* cited by examiner

ALARM SYSTEM HAVING AN INDICATOR LIGHT THAT IS EXTERNAL TO AN ENCLOSED SPACE FOR INDICATING THE SPECIFIC LOCATION OF AN INTRUSION INTO THE ENCLOSED SPACE AND A METHOD FOR INSTALLING THE ALARM SYSTEM

CROSS-REFERENCE TO RELATED APPLICATIONS

This application is a Continuation-in-Part of application Ser. No. 12/949,730, entitled "Alarm System Having An Indicator Light That Is External To An Enclosed Space For Indicating An Intrusion Into The Enclosed Space And A Method For Installing The Alarm System," and filed on Nov. 18, 2010, incorporated herein by reference in its entirety.

This application is also related to application Ser. No. 12/949,734, entitled "Alarm System Having An Indicator Light That Is External To An Enclosed Space For Indicating The Time Elapsed Since An Intrusion Into The Enclosed Space And A Method For Installing The Alarm System," and filed on Nov. 18, 2010, which is also a Continuation-in-Part of application Ser. No. 12/949,730, entitled "Alarm System Having An Indicator Light That Is External To An Enclosed Space For Indicating An Intrusion Into The Enclosed Space And A Method For Installing The Alarm System," and filed on Nov. 18, 2010.

FIELD

The invention relates generally to systems and methods for intruder detection, and more particularly to notification of an intruder detection event.

BACKGROUND

Security systems for protecting buildings and other structures from intrusion are well known in the art. Such security systems generally include one or more alarms to notify others of an attempted or actual intrusion. These alarms can include audible signals and/or lights to indicate when a breach or attempted breach of a structure, such as the prying open of a door or window, has occurred. Such security systems can help to protect building owners and/or inhabitants from would-be intruders and actual intruders, such as burglars.

While many of these systems activate alarms to notify others of attempted or successful intrusions, these systems typically do not provide information as to whether there was merely an attempted intrusion, or an actual intrusion. Other systems may activate an alarm only to indicate an actual intrusion, but the alarm may deactivate or may be deactivated before the user of the system arrives upon the scene of the intrusion.

Furthermore, without sound, the alarms of known alarm systems are not easily noticeable from outside an enclosed space that was intruded upon. For example, the alarms of some systems are small, inconspicuous, and silent panels of information about an intrusion. Still other alarms that do provide sound do not clearly identify and locate the enclosed space that was intruded upon. Even though a loud alarm may be activated upon intrusion, the general location of the enclosed space being intruded upon may be unclear or ambiguous to observers outside the enclosed space.

SUMMARY

An alarm system with an indicator light that is external to an enclosed space for indicating an intrusion into an enclosed space and the specific location of the intrusion into the enclosed space, and a method of installing such a system, are claimed. For example, the alarm system will show that the intrusion occurred at a specific wall or corner of the enclosed space, and/or a specific door or a specific window of the enclosed space, and/or some other specific portion of the enclosed space.

The system can be purchased and installed inexpensively and easily, and it can provide a signal that does not expire over time, and is easily recognizable and locatable to the user of the system upon the user's arrival at the enclosed space or the structure. The signal indicates the specific location of an intrusion into the enclosed space, thereby providing information to others regarding where an intruder might be lurking and perhaps lying in wait, within the enclosed space, and/or possibly where the intruder might exit as well.

Upon detecting an intrusion into the enclosed space, the alarm system employs an indicator light that is located within an outer perimeter zone that surrounds the enclosed space. Upon activation, the indicator light emits light that extends beyond the outer perimeter zone of the enclosed space as an intrusion alert, thereby reducing the need of a user to enter the outer perimeter zone of the enclosed space to determine the specific location of the intrusion. The alert is conspicuous and easily recognizable to anyone who approaches the outer perimeter zone of the enclosed space for which the external light alert is activated. An indicator light alarm is typically also easier for people to trace to its source than is a sound alarm, particularly if the enclosed space is situated close to other enclosed spaces with which it could be confused. The enclosed space can be a building, or a particular section or room of a building, for example.

The alarm system provides alerts regarding the specific location of an intrusion into an enclosed space and/or structure, in addition to alerting a user of an intrusion event generally. The alert provides specific location information regarding only successful intrusions into an enclosed space, as opposed to mere attempted intrusions.

The indication of the specific location of an intrusion into an enclosed space is information that can provide an observer with insight as to the nature of the intrusion, without requiring that the observer enter the enclosed space, or even enter the outer perimeter zone of the enclosed space. An alert indicating the specific location of an intrusion can therefore be helpful in a variety of ways, such as enhancing the decision-making process for the user or others investigating the intrusion, regarding how they would respond to the alert.

For example, information regarding the specific location of an intrusion can affect the decision-making process of someone investigating the intrusion, such as the police, on how to further investigate or respond to the intrusion.

The present alarm system having an indicator light that is external to an enclosed space for indicating the location of an intrusion into an enclosed space, can benefit from use with the invention disclosed in patent application Ser. No. 12/949,734, entitled "Alarm System Having An Indicator Light That Is External To An Enclosed Space For Indicating The Time Elapsed Since An Intrusion Into The Enclosed Space And A Method For Installing The Alarm System," and filed on Nov. 18, 2010.

In one embodiment, the invention is an alarm system for providing an indication of a specific location of an intrusion into an enclosed space, the enclosed space being surrounded by an outer perimeter zone, the indication enabling an observer situated outside the outer perimeter zone to learn the specific location of the intrusion, the alarm system comprising: at least one interior sensor located within an enclosed space, the interior sensor being configured to generate a specific intrusion location signal in response to an intrusion into the enclosed space; a light control system responsive to the specific intrusion location signal, the light control system being configured to control light emitted from an indicator light so as to indicate the specific location of the intrusion; and an indicator light capable of indicating the specific location of the intrusion, the indicator light being responsive to the light control system, the indicator light being located within an outer perimeter zone of the enclosed space, the indicator light being capable of emitting light that is visible from outside the outer perimeter zone of the enclosed space.

In another embodiment, the invention is a method of installing an alarm system for providing an indication of a specific location of an intrusion into an enclosed space, the enclosed space being surrounded by an outer perimeter zone, the indication enabling an observer situated outside the outer perimeter zone to learn the specific location of the intrusion, the alarm system comprising: mounting at least one interior sensor located within an enclosed space, the interior sensor being configured to generate a specific intrusion location signal in response to an intrusion into the enclosed space; installing a light control system responsive to the specific intrusion location signal, the light control system being configured to control light emitted from an indicator light so as to indicate the specific location of the intrusion; and mounting an indicator light capable of indicating the specific location of the intrusion, the indicator light being responsive to the light control system, the indicator light being located within an outer perimeter zone of the enclosed space, the indicator light being capable of emitting light that is visible from outside the outer perimeter zone of the enclosed space.

In some embodiments, the at least one interior sensor is capable of detecting intrusion into the enclosed space in proximity to a peripheral window of the enclosed space, a peripheral door of the enclosed space, a chimney of the enclosed space, and/or a general internal area of the enclosed space. In some embodiments, the indicator light is capable of directing light towards the specific location of the intrusion. In other embodiments, the indicator light is capable of directing light towards at least one of an external side of the enclosed space, an outer corner of the enclosed space, a door, a window, and/or a chimney. In other embodiments, the indicator light is located in immediate proximity to the specific location of the intrusion. In some of these embodiments, indicator light surrounds the specific location of the intrusion.

In some embodiments, the light is a focused light beam, a beacon light, a blinking light, and/or a rotating light. In other embodiments, the indicator light is a light display that is capable of producing a readable output of the specific location of the intrusion.

In some embodiments, the specific intrusion location signal is also received on a mobile device. In other embodiments, the system can be activated by a keypad installed near an entrance of the enclosed space, a keypad installed within the outer perimeter zone of the enclosed space, a manual key configured to fit a manual lock, a remote control device dedicated to activation of the system, a personal mobile communication device.

BRIEF DESCRIPTION OF THE DRAWINGS

The invention will be more fully understood by reference to the detailed description, in conjunction with the following figures, wherein.

DETAILED DESCRIPTION

Figure 1A:
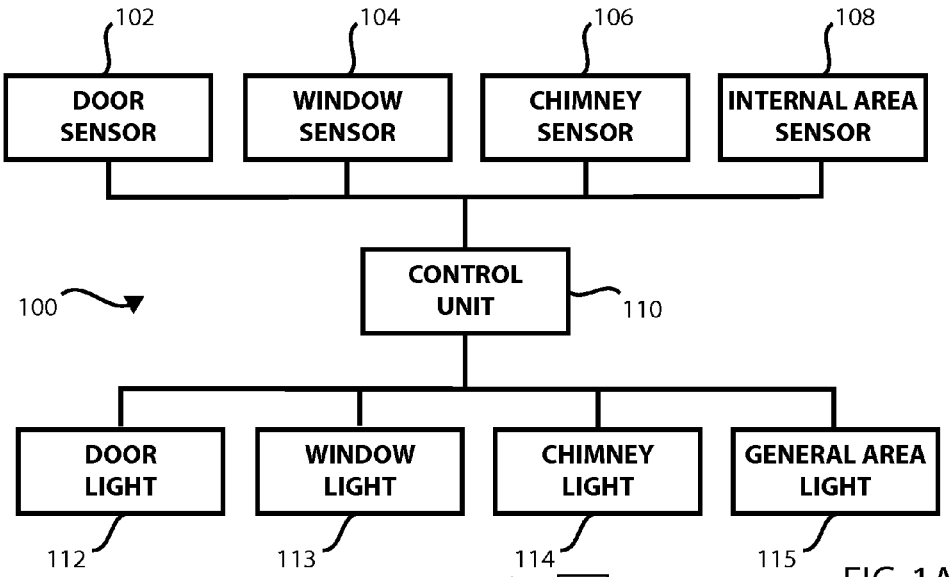
FIG. 1A is a block diagram showing the main elements of an embodiment of the alarm system.

FIG. 1A is a block diagram showing the main elements of an embodiment of the alarm system. In the embodiment represented by the diagram of the system elements 100, several interior sensors are placed within an interior space of a building, which in this case is a house.

The enclosed space to be equipped with the alarm system can be any building or enclosed portion of a building (such as a section or room of the building) for which a user of the system wishes to receive notice of the intrusion by another into the enclosed space. Such enclosed space can include rooms, sections, levels, or entire internal areas of buildings such as houses, apartments, schools, dorm rooms, office buildings, factories, or any other buildings apparent to one of ordinary skill in the art of intrusion alert systems.

In the embodiment shown, the sensors are placed in such a manner so as to detect intrusion of the building. In alternative embodiments, sensors can be strategically placed so as to detect intrusion of a certain particular enclosed space of the building, such as a particular room or group of adjacent rooms, or an entire floor level of the building, for example. The exemplary sensors shown include a door sensor 102, a window sensor 104, a chimney sensor 106, and an internal area sensor 108.

Sensors can be placed in proximity to access points to the building or an enclosed portion of the building, so as to detect intrusion of the enclosed space through the access point. Such access points which the sensor may be placed near can include a door 102, window 104 or chimney 106, for example. Another sensor can be placed within a general internal area of an enclosed space 108, so as to detect movement inside the enclosed space, or so as to employ any other means of detecting intrusion apparent to one of ordinary skill in the art of intrusion detection.

The sensors can be any kind of sensor configured to detect intrusion, such as a heat sensor or infrared sensor, for example. One skilled in the art will appreciate and readily acknowledge other possible sensors which can be used. If an intrusion occurs, a sensor will detect the intrusion and send a specific intrusion location signal to a control unit 110. The control unit 110 will send the specific intrusion location signal to an indicator light located outside the enclosed space and in an outer perimeter zone of the enclosed space. The control unit 110 can serve as a light control system, configured to control the light so as to indicate the location of intrusion.

The indicator light will emit light so as to indicate that an intrusion has occurred, and to indicate the location of the intrusion. Other sensors positioned and configured to detect movement within the enclosed space for which intrusion is to be detected will be readily apparent to one ordinarily skilled in the art of intrusion detection. A light control system controls light emitted by the indicator light so as to indicate the location of the intrusion.

Figure 1B:
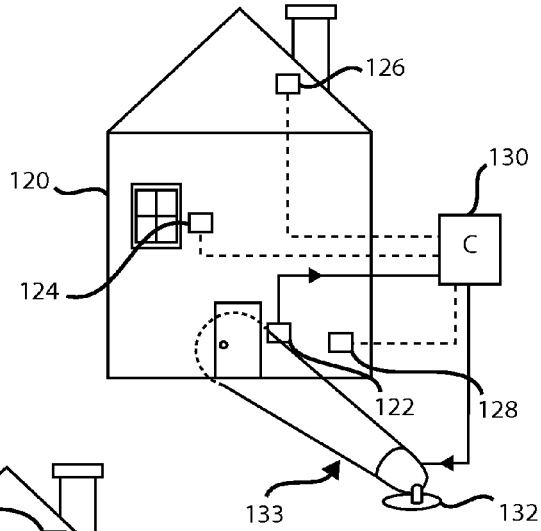
FIG. 1B is an elements diagram showing the interaction between the main elements of an embodiment of the alarm system wherein the main elements are hard wired together.

FIG. 1B is an elements diagram showing the interaction between the main elements of an embodiment of the alarm system, wherein the main elements are hard wired together with electrical wiring. A house 120 equipped with an embodiment of the alarm system is shown, containing a door sensor 122, window sensor 124, chimney sensor 126, and internal area sensor 128.

As depicted in this diagram, the sensors are hard wired to a common control unit 130, which in turn is in hard wire communication with an indicator light 132. In the embodiment shown, the control unit 130 is located outside the structure of the house 130. Upon receiving a specific intrusion location signal from any of the sensors, the control unit 130 can propagate the signal to the indicator light 132 located in the outer perimeter zone of the enclosed space, which emits light that is visible beyond the outer perimeter zone of the enclosed space, thereby alerting others to an intrusion and the location of the intrusion. In this embodiment, the indicator light 132 is located outside the house but within a curtilage of the house 120, and produces light that is visible beyond the curtilage.

In the embodiment shown, the indicator light 132 emits a light beam 133 that is directed towards the location of the intrusion, so as to indicate the location of the intrusion. In this example, the light 133 is directed towards the front door of the house, so as to indicate that the house was intruded via the front door.

Figure 1C:
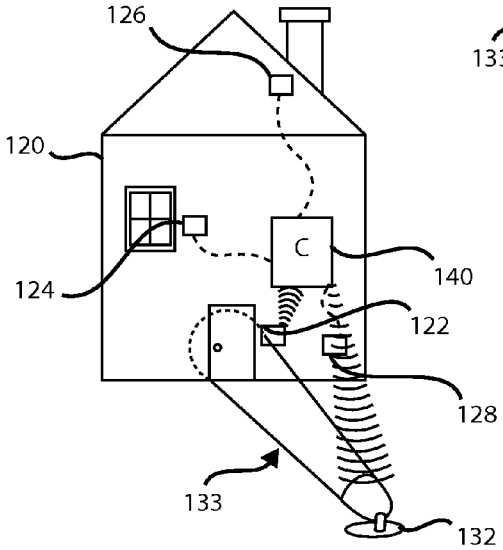
FIG. 1C is an elements diagram showing the interaction between the main elements of an alternative embodiment of the alarm system wherein the main elements are connected together via wireless communication.

FIG. 1C is an elements diagram showing the interaction between the main elements of an alternative embodiment of the alarm system wherein the main elements are connected together via wireless signaling. A house 120 equipped with an embodiment of the alarm system is shown, containing a door sensor 122, window sensor 124, chimney sensor 126, and internal area sensor 128.

As depicted in this diagram, the sensors are linked via wireless connection to a common control unit 140, which in turn is in wireless communication with an indicator light 132. In the embodiment shown, the control unit 140 is located inside the structure of the house 120. Upon receiving a specific intrusion location signal from any of the sensors, the control unit 130 can propagate the signal to the indicator light 132 located in the outer perimeter zone of the enclosed space, which emits light that is visible beyond the outer perimeter zone of the enclosed space, thereby alerting others to an intrusion and the location of the intrusion. In this embodiment, the indicator light 132 is located outside the house but within a curtilage of the house 120, and produces light that is visible beyond the curtilage.

In the embodiment shown, the indicator light 132 emits a light beam 133 that is directed towards the location of the intrusion, so as to indicate the location of the intrusion. In this example, the light 133 is directed towards the front door of the house, so as to indicate that the house was intruded via the front door.

Figure 2A:
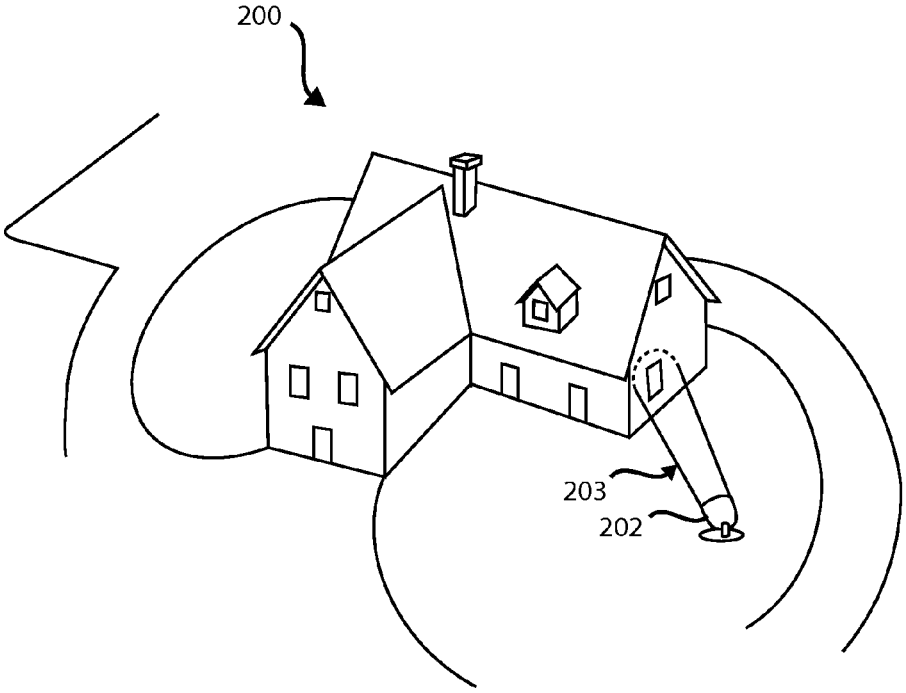
FIG. 2A is an aerial view of a house equipped with an installed version of an embodiment of the alarm system, showing the light output indicating a specific location of an intrusion.

FIG. 2A is an aerial view of a house equipped with an installed version of an embodiment of the alarm system, showing the light output indicating a specific location of an intrusion. In this embodiment, the house 200 is equipped with an indicator light 202 that emits a continuous light beam 203.

In the embodiment shown in this figure, the light beam 203 is a window light 113 directed at a window through which the house has been intruded upon. Therefore, in this embodiment the indicator light 202 indicates the location of intrusion by directing the light beam 203 towards the specific intrusion location.

Figure 2B:
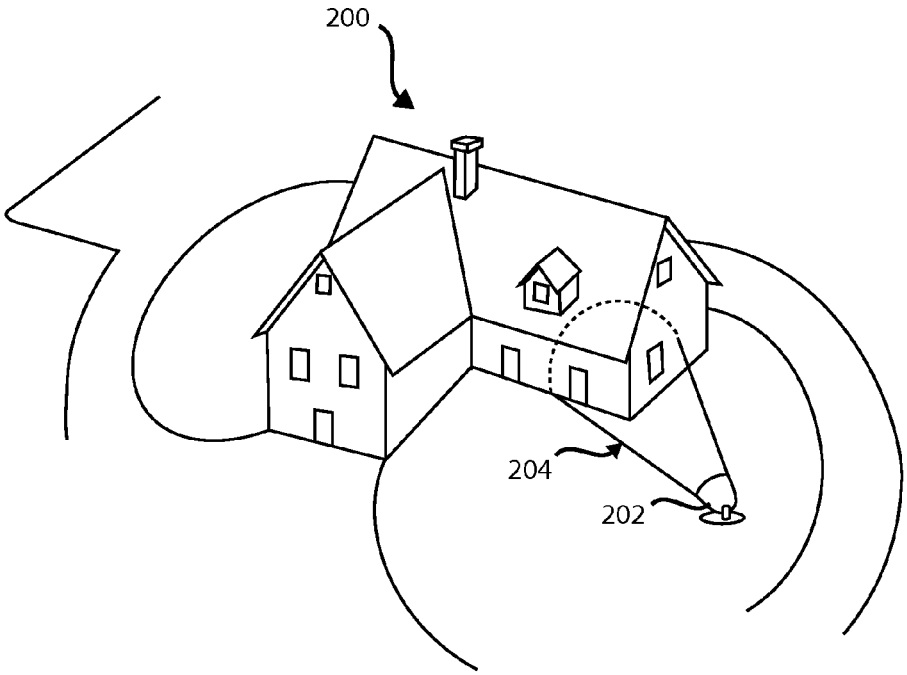
FIG. 2B is an aerial view of a house equipped with an installed version of the embodiment shown in FIG. 2A, showing the light output indicating a more general location of an intrusion.

FIG. 2B is an aerial view of a house equipped with an installed version of the embodiment shown in FIG. 2A, showing the light output indicating a more general location of an intrusion. In this embodiment, the house 200 is equipped with an indicator light 202 that emits a continuous light beam 204.

In the embodiment shown in this figure, the light beam 204 is a general area light 115 directed at a corner section of the house. The light beam 204 indicates that intrusion occurred within one of the entry points illuminated by the light beam 204, including a front-facing window and a side-facing window. Such general information can be the result of an internal area sensor 108, for example. The specific intrusion location signal will therefore provide more general information, than a specific intrusion location signal sent by a sensor dedicated to detecting intrusion of a specific access point, such as the embodiment shown and discussed in FIG. 2A.

Figure 3:
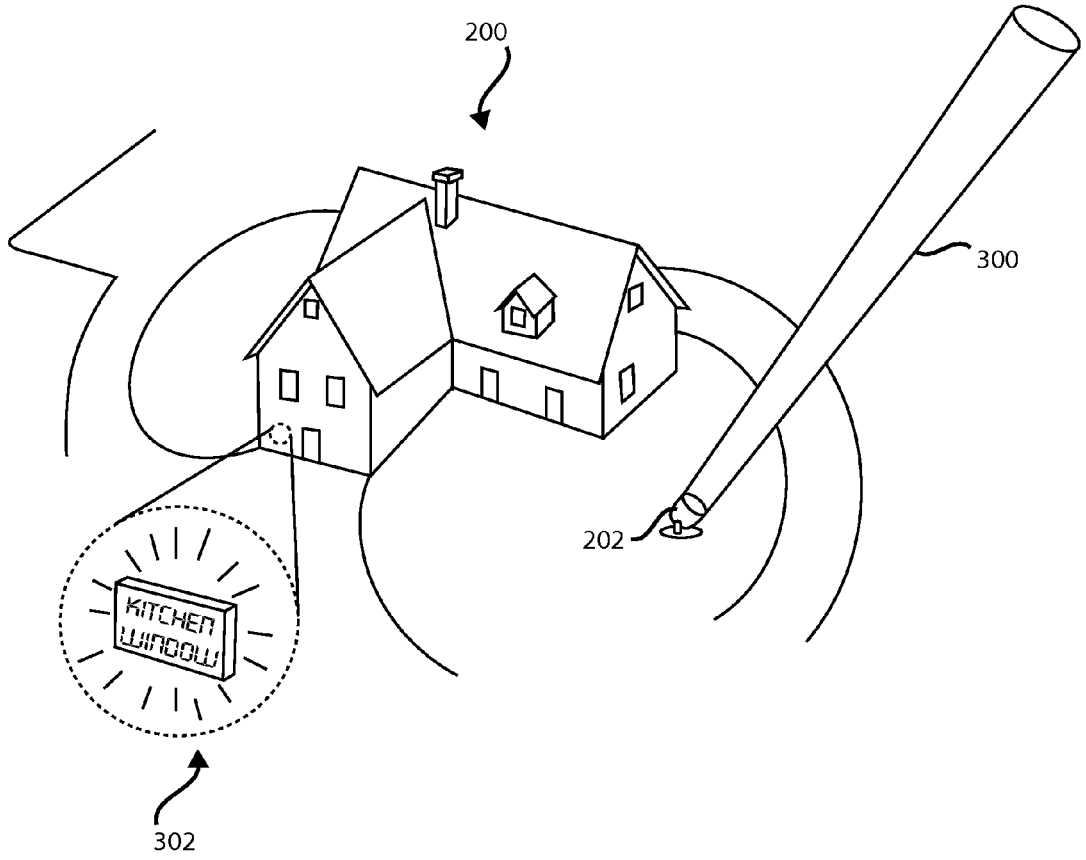
FIG. 3 is an aerial view of a house equipped with an embodiment of a combination of indicator lights of the alarm system.

FIG. 3 is an aerial view of a house equipped with an embodiment of a combination of indicator lights of the alarm system. A house 200 is equipped with an indicator light 202 that emits a continuous light beam 300. In addition, this embodiment also includes a light display 302 capable of producing a readable output of the location of the intrusion, wherein the light control system is configured to control the readable output that is produced by the light display 302. In the embodiment shown, the light display 302 is located on a wall near a doorway into the house 200. The light display 302 is indicating that intrusion occurred through a kitchen window of the house 200.

Figure 4:
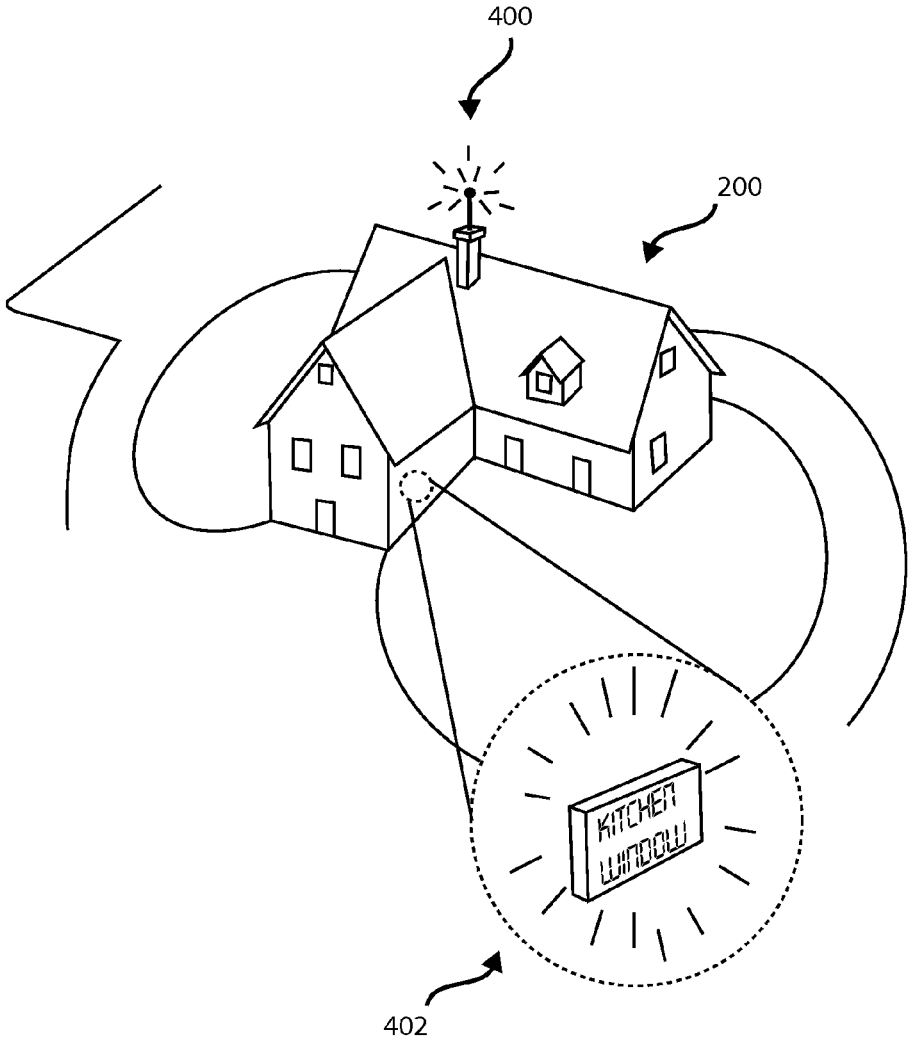
FIG. 4 is an aerial view of a house equipped with an alternative embodiment of a combination of indicator lights of the alarm system.

FIG. 4 is an aerial view of a house equipped with an alternative embodiment of a combination of indicator lights of the alarm system. A house 200 is equipped with an indicator light 400 that emits a beacon light 400, such as light emitted omni-directionally from a bulb, as opposed to a focused beam. The beacon light 400 can be light of continuous output, or alternatively, it can be light of non-continuous output, such as a blinking light. The beacon light 400 is installed at the top of the house 200.

In addition, this embodiment also includes a light display 402 capable of producing a readable output of the location of the intrusion, wherein the light control system is configured to control the readable output that is produced by the light display 402. In the embodiment shown, the light display 402 is located on a wall around the corner from a doorway into the house 200. The light display 402 is indicating that intrusion occurred through a kitchen window of the house 200.

Figure 5:
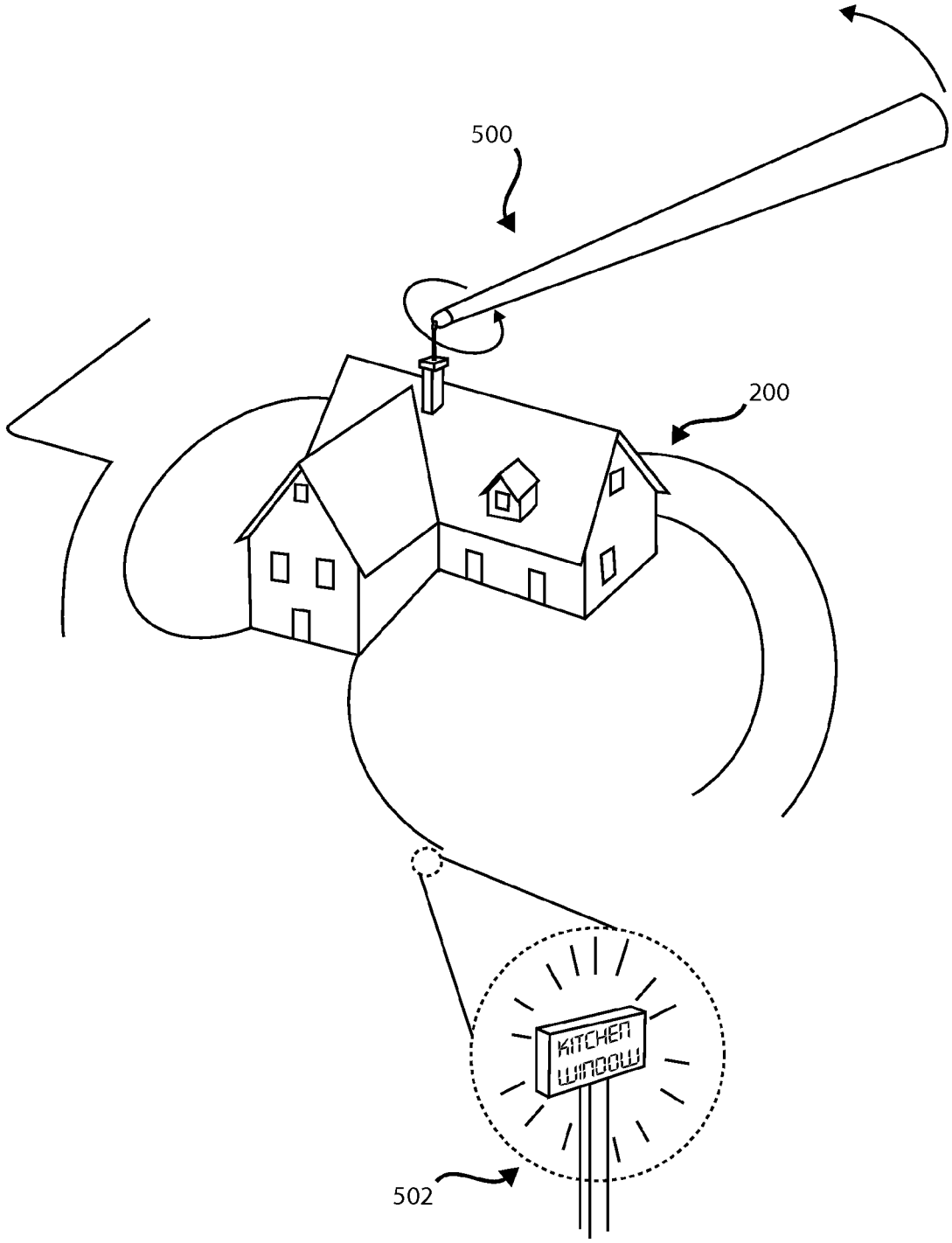
FIG. 5 is an aerial view of a house equipped with another alternative embodiment of a combination of indicator lights of the alarm system.

FIG. 5 is an aerial view of a house equipped with another alternative embodiment of a combination of indicator lights of the alarm system. In this embodiment, the house 200 is equipped with a rotating light beam 500, which is installed at the top of the house 200. The light beam 500 is projected substantially horizontally from a rotating light source. In the embodiment shown, the rotating light beam 500 is a focused light beam which rotates about the vertical axis of its light source. This rotating light 600 can potentially alert others in all directions beyond the curtilage of the house 400, potentially including those located within neighboring dwellings.

In addition, this embodiment also includes a light display 500 capable of producing a readable output of the location of the intrusion, wherein the light control system is configured to control the readable output that is produced by the light display 500. In the embodiment shown, the light display 500 is located on a walkway towards a doorway of the house 200. The light display 500 is indicating that intrusion through a kitchen window of the house 200.

Figure 6:
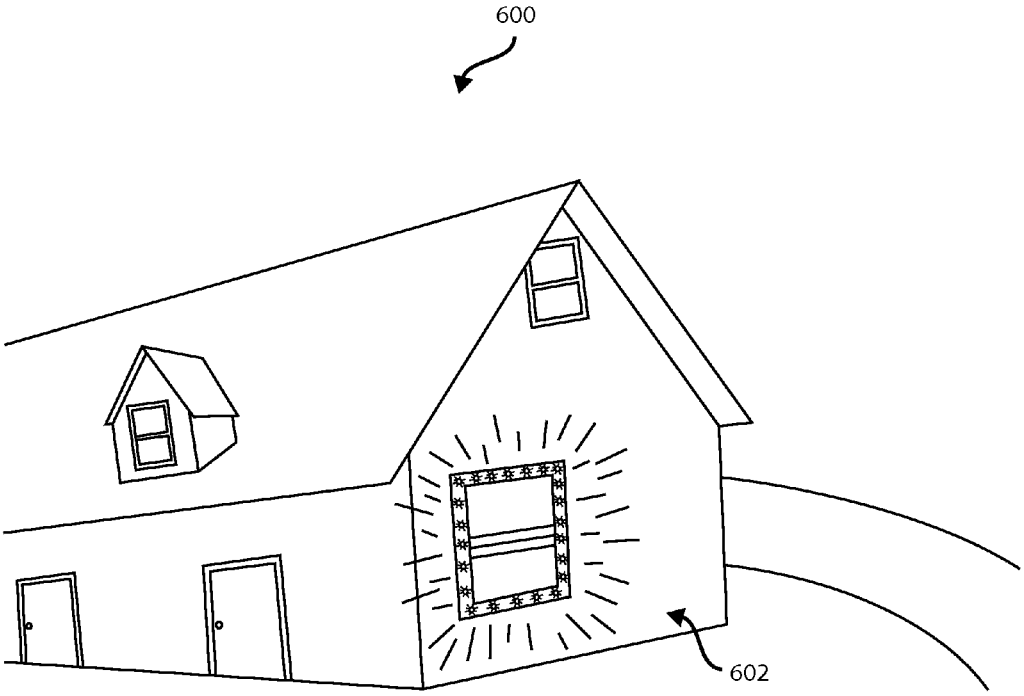
FIG. 6 is side view of a house equipped with another alternative embodiment of a combination of indicator lights of the alarm system.

FIG. 6 is side view of a house equipped with another alternative embodiment of a combination of indicator lights of the alarm system. In the embodiment shown, a house 600 includes a light display 602 comprised of a plurality of lights surrounding the perimeter of a possible location of intrusion. In the embodiment shown, a series of lights surround the perimeter of a window. The lights are illuminated, thereby alerting others that the house 200 has been intruded upon, via the window that is illuminated by the light display 602.

Figure 7:
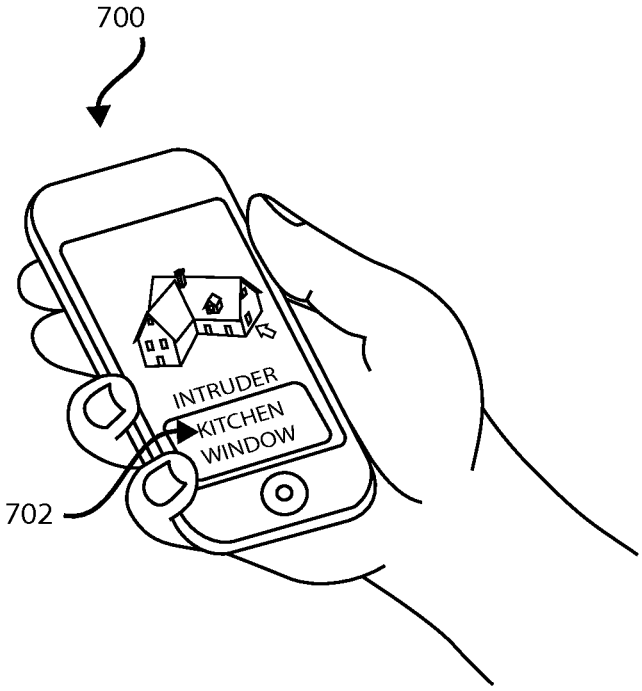
FIG. 7 is an illustration of a component of an embodiment of the alarm system, wherein a specific intrusion location message is produced on a mobile device.

FIG. 7 is an illustration of a component of an embodiment of the alarm system, wherein a specific intrusion location message is produced on a mobile device. In the embodiment shown, a mobile device 700 receives a specific intrusion location message 702, in addition to an indicator light signal being projected from the outer perimeter zone of the enclosed space with which the indicator light is associated. Such a mobile device specific intrusion location message 702 can supplement the indicator light, providing an enhancement to the alarm system. For example, if an intrusion is detected, the alarm system can alert those for whom the intruded enclosed space is in sight. In addition, a user of the alarm system can receive an alert 702 on their mobile device 700, which can be an important and useful supplemental alert if and when they are not near or approaching the enclosed space. In the embodiment shown, the specific intrusion location message 702 indicates that intrusion occurred through a kitchen window of the house.

Figure 8:
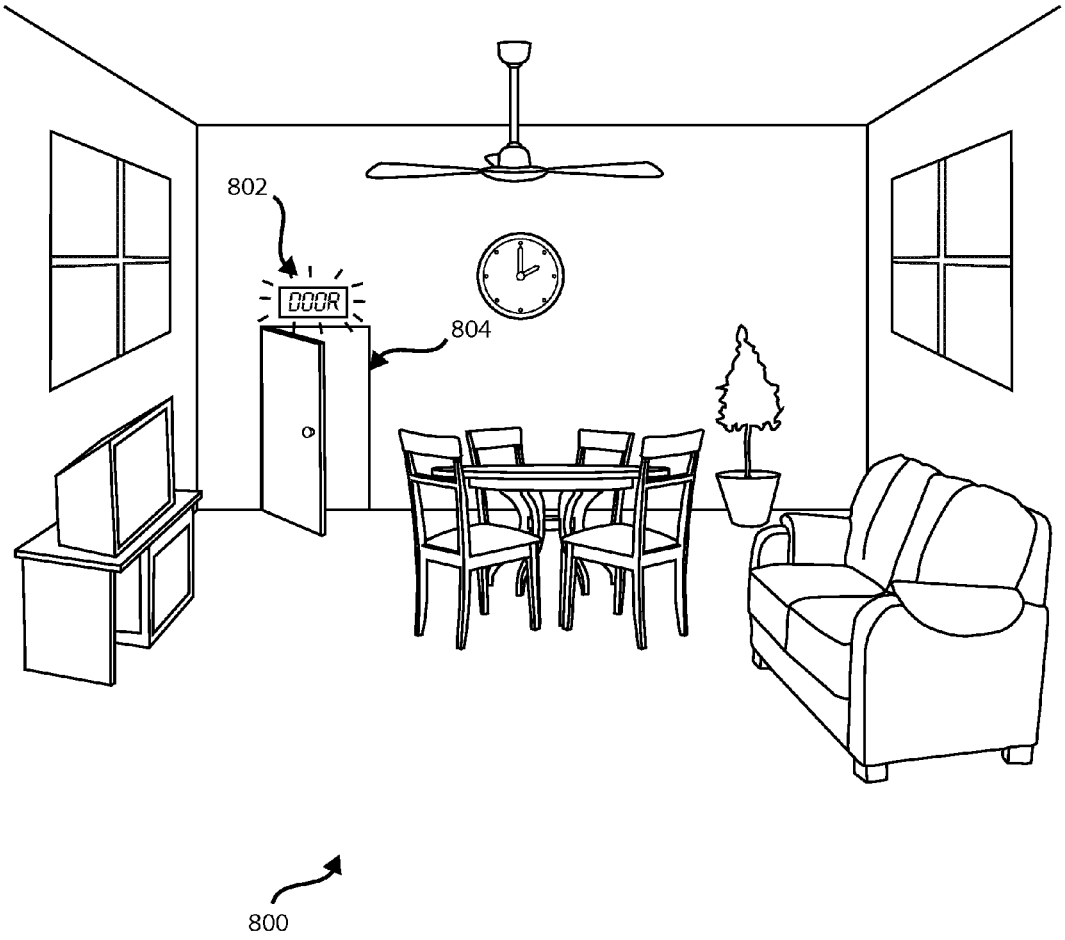
FIG. 8 is an illustration of a room within a building employing an embodiment of the alarm system.

FIG. 8 is an illustration of a room within a building employing an embodiment of the alarm system. In this embodiment, the alarm system is configured to alert others of the location of an intrusion into an enclosed space within a building, in this instance the enclosed space being a room of a house. In this embodiment, a room 800 adjacent to the intruded room is equipped with an indicator light 802. The indicator light in this example is a light display 802 which indicates readable output concerning the location of the intrusion.

The light display 802 shown is capable of producing a readable output of the location of the intrusion, wherein a light control system is configured to control the readable output that is produced by the light display. In the embodiment shown, the light display 802 is located above a doorway 804 which leads from the adjacent room 800 into the intruded room. The light display 802 is indicating that intrusion occurred through the door.

The indicator light 802 is located within the outer perimeter zone of the room equipped with the alarm system, and the light display 802 is visible and readable beyond the outer perimeter zone of the room equipped with the alarm system. For example, someone in the adjacent room 800 could easily see the light display and read the output. In some embodiments, several such indicator lights 802 may be placed at various locations within the outer perimeter zone of the enclosed space equipped with the alarm system, so as to alert others in various neighboring rooms, for example.

If an unexpected intrusion occurs in one room, the indicator light 802 can alert others in adjacent rooms 800 of the intrusion, for example. In other embodiments, the enclosed space under surveillance may be a group of rooms, or some other portion of a building, for example. The indicator light 802 is located in the outer perimeter zone immediately outside the enclosed space under surveillance. In this case, the outer perimeter zone includes the doorway 804 and wall of an adjacent room 800. The indicator light 802 is therefore mounted on the adjacent wall of the doorway 804 connecting the intruded room with the adjacent room 800.

Figure 9A:
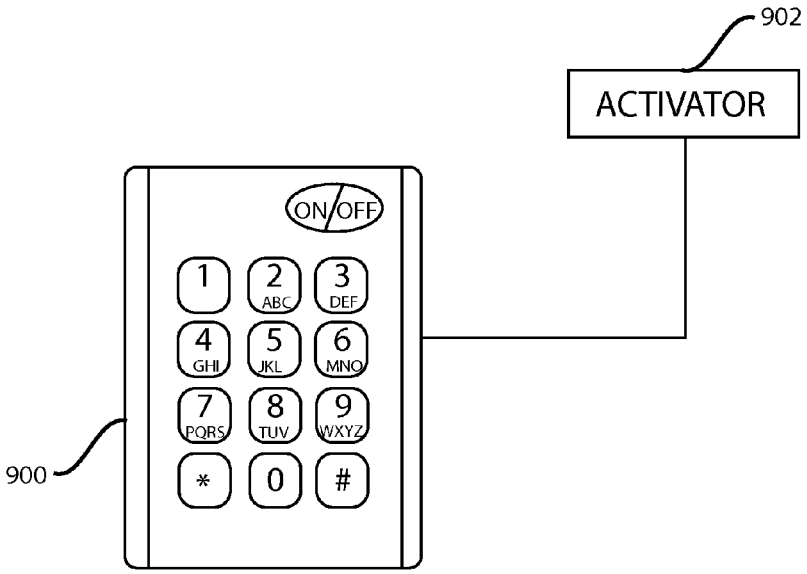
FIG. 9A depicts a keypad configured to control activating system for an embodiment of the alarm system.

The alarm system can be activated through a variety of techniques, some of which are discussed explicitly in this specification, while still others will be readily apparent to one of ordinary skill in the art. FIG. 9A depicts a keypad 900 configured to control an activating system in an embodiment of the alarm system. Such a keypad can be installed on an outer wall of a house, near an entrance into the house for example, or somewhere near the house and within the curtilage of the house, for example. The keypad is connected to and capable of communicating with an activator 902 which can activate the system.

Figure 9B:
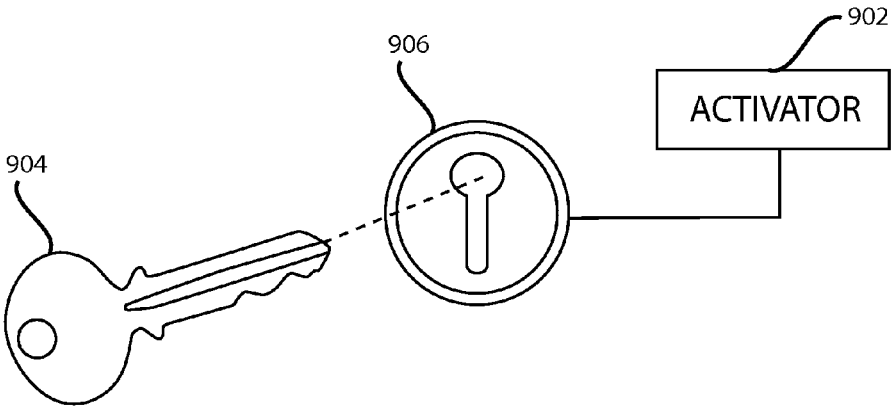
FIG. 9B depicts a manual key and lock configured to control an activating system for an embodiment of the alarm system.

FIG. 9B depicts a manual key and lock configured to control an activating system for an embodiment of the alarm system. In this embodiment, a manual key 904 can fit into a manual keyhole 906, and whereupon the key 904 is inserted into the keyhole 906 and turned, the alarm system can be activated and/or deactivated via communication with an activator 902.

Figure 9C:
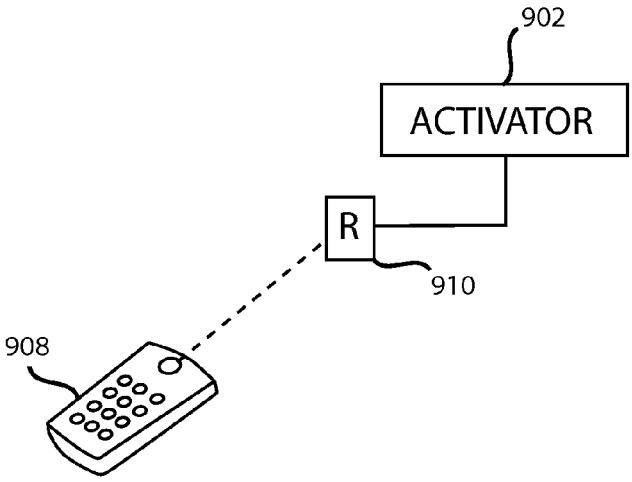
FIG. 9C depicts a remote dedicated device and receiver configured to control an activating system for an embodiment of the alarm system.
Figure 9D:
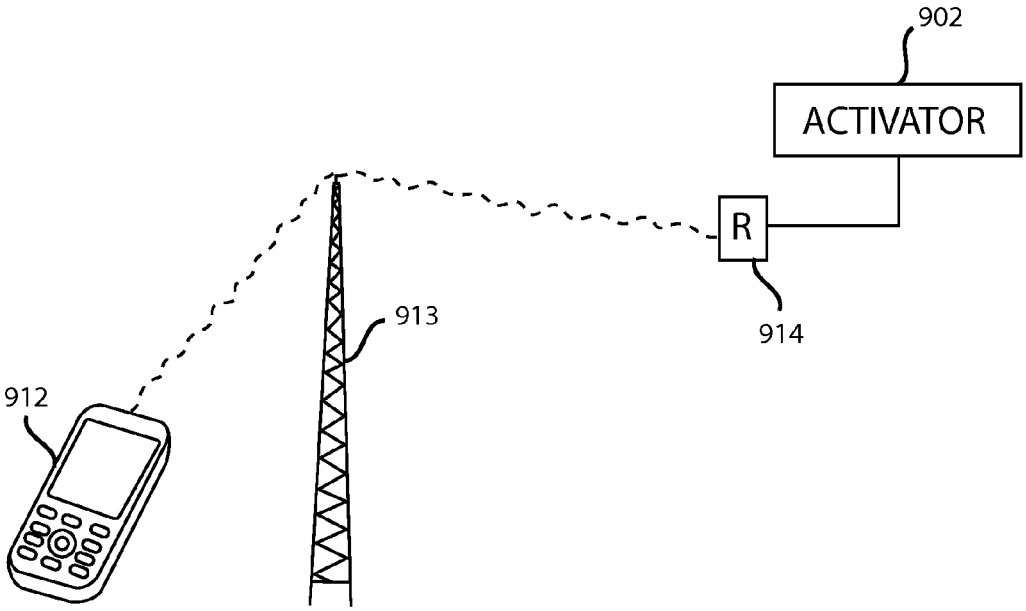
FIG. 9D depicts a personal mobile device and receiver configured to control an activating system for an embodiment of the alarm system.

The alarm system can also be activated via remote devices. FIG. 9C depicts a dedicated remote device 908 and a receiver 910, which in combination are configured to control an activating system in an embodiment of the alarm system. A user of the system can activate the system using a remote control 908 which communicates with a receiver 910, which in turn is linked to an activator 902. FIG. 9D depicts a personal mobile device 912 and reception tower 913 in communication with a receiver 914, which in turn is linked to an activator 902 and configured to control an activating system for an embodiment of the alarm system. Still other activation systems will be readily apparent to one of average skill in the art.

Figure 10:
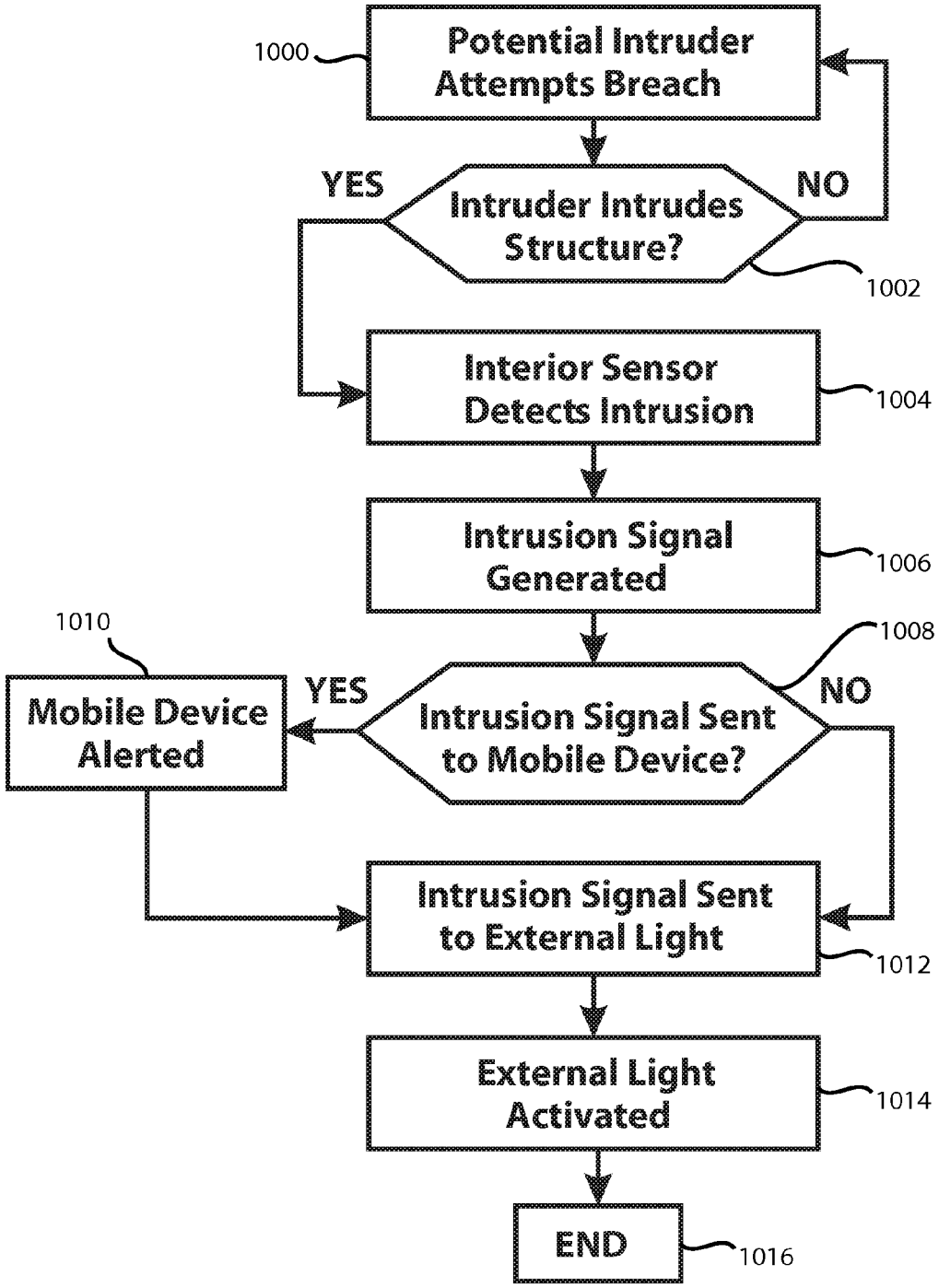
FIG. 10 is a flowchart depicting a sequence of events related to an embodiment of the alarm system in use.

FIG. 10 is a flowchart depicting a sequence of events related to an embodiment of the alarm system in use, in relation to a structure. First, a potential intruder attempts to breach and/or intrude a structure or other enclosed space equipped with the system 1000, with intent to intrude the structure or enclosed space. In this embodiment, the entire structure is equipped with the system, while in alternative embodiments only a sub-enclosure, such as a room within the structure, might be so equipped.

If the intruder succeeds in intruding the structure 10002, an interior sensor will detect the intrusion 1004 and generate an intrusion signal 1006, which in the present invention is a specific intrusion location signal indicating the location of the intrusion. If the system includes for the specific intrusion location signal to be sent to a user's mobile device 1008, then the mobile device can be alerted 1010. The specific intrusion location signal is sent to an indicator light 1012, which then activates and outputs an alarm light 1014 upon receiving the information regarding the intrusion time signal. The indicator light indicates the location of intrusion. This completes the main operation of the system 1016.

Other modifications and implementations will occur to those skilled in the art without departing from the spirit and the scope of the invention as claimed. Accordingly, the above description is not intended to limit the invention except as indicated in the following claims.

The invention claimed is:

1. An alarm system for providing an indication of a specific location of an intrusion into an enclosed space, the enclosed space being surrounded by an outer perimeter zone, the indication enabling an observer situated outside the outer perimeter zone to learn the specific location of the intrusion, the alarm system comprising:

at least one interior sensor located within an enclosed space, the interior sensor being configured to generate a specific intrusion location signal in response to an intrusion into the enclosed space;

a light control system responsive to the specific intrusion location signal, the light control system being configured to control light emitted from an indicator light so as to indicate the specific location of the intrusion; and an indicator light being configured to indicate the specific location of the intrusion, the indicator light being responsive to the light control system, the indicator light being located within an outer perimeter zone of the enclosed space, the indicator light being configured to emit light that is visible from outside the outer perimeter zone of the enclosed space, the indicator light being configured to direct light towards the specific location of the intrusion.

2. The alarm system of claim 1, wherein the at least one interior sensor is configured to detect intrusion into the enclosed space in proximity to at least one of:

a peripheral window of the enclosed space;
a peripheral door of the enclosed space;
a chimney of the enclosed space; and
a general internal area of the enclosed space.

3. The alarm system of claim 1, wherein the indicator light is configured to direct light towards at least one of:

an external side of the enclosed space;
an outer corner of the enclosed space;
a door;
a window; and
a chimney.

4. The alarm system of claim 1, wherein the indicator light is located in immediate proximity to the specific location of the intrusion.

5. The alarm system of claim 1, wherein an indicator light surrounds the specific location of the intrusion.

6. The alarm system of claim 1, wherein the light is at least one of:

a focused light beam;
a beacon light;
a blinking light; and
a rotating light.

7. The alarm system of claim 1, wherein the indicator light is a light display that is configured to produce a readable output of the specific location of the intrusion.

8. The alarm system of claim 1, wherein the specific intrusion location signal is also received on a mobile device.

9. The alarm system of claim 1, wherein the system can be activated by at least one of:

a keypad installed near an entrance of the enclosed space;
a keypad installed within the outer perimeter zone of the enclosed space;
a manual key configured to fit a manual lock;
a remote control device dedicated to activation of the system; and
a personal mobile communication device.

10. A method of installing an alarm system for providing an indication of a specific location of an intrusion into an enclosed space, the enclosed space being surrounded by an outer perimeter zone, the indication enabling an observer situated outside the outer perimeter zone to learn the specific location of the intrusion, the alarm system comprising:

mounting at least one interior sensor located within an enclosed space, the interior sensor being configured to generate a specific intrusion location signal in response to an intrusion into the enclosed space;

installing a light control system responsive to the specific intrusion location signal, the light control system being configured to control light emitted from an indicator light so as to indicate the specific location of the intrusion; and mounting an indicator light configured to indicate the specific location of the intrusion, the indicator light being responsive to the light control system, the indicator light being located within an outer perimeter zone of the enclosed space, the indicator light being configured to emit light that is visible from outside the outer perimeter zone of the enclosed space, the indicator light being configured to direct light towards the specific location of the intrusion.

11. The method of claim 10, wherein the at least one interior sensor is configured to detect intrusion into the enclosed space in proximity to at least one of:

a peripheral window of the enclosed space;
a peripheral door of the enclosed space;
a chimney of the enclosed space; and
a general internal area of the enclosed space.

12. The method of claim 10, wherein the indicator light is configured to direct light towards at least one of:

an external side of the enclosed space;
an outer corner of the enclosed space;
a door;
a window; and
a chimney.

13. The method of claim 10, wherein the indicator light is located in immediate proximity to the specific location of the intrusion.

14. The method of claim 10, wherein an indicator light surrounds the specific location of the intrusion.

15. The method of claim 10, wherein the light is at least one of:

a focused light beam;
a beacon light;
a blinking light; and
a rotating light.

16. The method of claim 10, wherein the indicator light is a light display that is configured to produce a readable output of the specific location of the intrusion.

17. The method of claim 10, wherein the specific intrusion location signal is also received on a mobile device.

18. The method of claim 10, wherein the system can be activated by at least one of:

a keypad installed near an entrance of the enclosed space;

a keypad installed within the outer perimeter zone of the enclosed space;

a manual key configured to fit a manual lock;

a remote control device dedicated to activation of the system; and a personal mobile communication device.

* * * * *